US011939108B1

(12) United States Patent
Wahl et al.

(10) Patent No.: US 11,939,108 B1
(45) Date of Patent: Mar. 26, 2024

(54) MODULAR SHIPPING BASE

(71) Applicant: Big 3 Precision Products, Inc., Centralia, IL (US)

(72) Inventors: David Michael Wahl, Beverly Hills, MI (US); Roger Lee Heinzmann, Walnut Hill, IL (US)

(73) Assignee: Big 3 Precision Products, Inc., Centralia, IL (US)

( * ) Notice: Subject to any disclaimer, the term of this patent is extended or adjusted under 35 U.S.C. 154(b) by 0 days.

(21) Appl. No.: 18/374,366

(22) Filed: Sep. 28, 2023

Related U.S. Application Data

(63) Continuation of application No. 29/897,050, filed on Jul. 11, 2023.

(60) Provisional application No. 63/541,105, filed on Sep. 28, 2023.

(51) Int. Cl.
*B65D 19/06* (2006.01)

(52) U.S. Cl.
CPC ..... *B65D 19/06* (2013.01)

(58) Field of Classification Search
CPC ..... B65D 19/02; B65D 19/06; B65D 19/18; B65D 19/40
USPC ..... 206/386
See application file for complete search history.

(56) References Cited

U.S. PATENT DOCUMENTS

| | | | | |
|---|---|---|---|---|
| D258,948 | S | 4/1981 | Stump | |
| 5,094,175 | A | 3/1992 | Christie | |
| D404,179 | S | 1/1999 | Apps et al. | |
| D464,186 | S | 10/2002 | Medoff et al. | |
| 9,487,326 | B2 | 11/2016 | Banik et al. | |
| 9,487,329 | B2 | 11/2016 | Balazs et al. | |
| 9,580,237 | B2 | 2/2017 | Nolan et al. | |
| D825,882 | S | 8/2018 | Thompson | |
| 10,301,068 | B2 | 5/2019 | Nottestad et al. | |
| 10,457,444 | B2 | 10/2019 | Banik et al. | |
| 10,858,148 | B1 | 12/2020 | Heinzmann et al. | |
| 2013/0068143 | A1* | 3/2013 | Skudutis | B29C 65/00 108/57.33 |
| 2019/0016503 | A1* | 1/2019 | Weyrauch | B65D 19/40 |
| 2020/0062449 | A1* | 2/2020 | Marovac | B65D 19/0018 |
| 2020/0198835 | A1* | 6/2020 | Burns | B65D 19/08 |
| 2022/0227529 | A1* | 7/2022 | Jang | B65D 19/06 |

* cited by examiner

*Primary Examiner* — Jacob K Ackun
(74) *Attorney, Agent, or Firm* — Mark A. Pitchford; Eric B. Fugett; Pitchford Fugett, PLLC

(57) ABSTRACT

A re-usable, returnable, stackable, modular shipping base that incorporates replaceable components to make the base relatively quick and cost effective to repair. The shipping base is formed from a number of stamped or cut sheet materials (e.g., sheet metal) that are then folded and attached to one another using a tab system. When a component is damaged, the damaged component may be removed from the base and replaced with another mass produced, stamped sheet material component. Components are attached to one another via adhesive, rivets, stitch welding, spot welding, or any other applicable process.

20 Claims, 10 Drawing Sheets

MODULAR SHIPPING BASE

CROSS-REFERENCE TO RELATED APPLICATIONS

This application claims priority to U.S. Design patent application Ser. No. 29/897,050 entitled "SHIPPING BASE" filed on Jul. 11, 2023.

This application claim priority to U.S. Provisional Patent Application No. 63/541,105 entitled "MODULAR SHIPPING BASE" filed on Sep. 28, 2023.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FEDERALLY SPONSORED RESEARCH AND DEVELOPMENT

Not Applicable

BACKGROUND OF THE INVENTION

The present invention relates generally to pallets or shipping bases. More particularly, this invention pertains to non-wooden, repairable shipping bases.

Materials and finished goods are generally shipped by truck, rail, boat, or aircraft. Unless lifting features are integral to the product packaging, shipping materials and finished goods requires some type of container or base that provides lifting features for equipment to load, unload or move the goods in transit from the supplier to the buyer. The most common lifting equipment for smaller unitized loads is the fork-truck or pallet truck, and the most common base is the wooden pallet (ladder or slat-style).

Alternatives to the wooden pallet design include injection molded plastic, heavy wood fiber board (cardboard) pallets (i.e., bases), and fabricated metal bases (cut and welded from standard steel or aluminum stock including rectangular tubing, angle iron, and channel). Most designs are simple platforms with enough depth to allow fork-truck access. Some designs include side panels to contain and protect loose bulk-loaded parts. Shipping bases in this class generally are produced in a limited number of "standardized" sizes (length/width), usually to accommodate maximum loading for the expected method of transportation. For instance, if over-the-road transportation by truck is expected, the base sizes will be chosen to be in units that allow full trailer/van bed coverage by bases placed side-by-side and front-to-back along the trailer, to maximize the amount of product being shipped on each trailer, which minimizes shipping costs on a per unit basis. The weight of the base is also important because shipping costs can be affected by the total weight being shipped, and the weight of the base adds to the total shipping weight and cost without adding to the amount of product actually delivered.

The cost of the various base designs, and their re-usability, vary by material and manufacturing method utilized. Wooden pallets are generally the least expensive, and are usually considered disposable or "one-way" shipping bases, as are heavy cardboard designs. Wooden pallets can certainly be reused, but the shipping and logistics costs to return them to a supplier can easily exceed the cost of new pallets. When re-used, they are most commonly re-used by the recipient to ship finished goods on to the buyer of those goods instead of being sent back to the supplier from which they were received. Injection-molded plastic bases are more expensive to produce, and fabricated metal bases are usually even more expensive. The more expensive a design is, the more they are generally intended to be reused and are often returned to the originator (i.e., supplier). Also, the more a particular style costs, the more incentive there is to be able to (cheaply) repair or refurbish them to keep them in service.

The simple wooden pallet can be easily repaired, but the logistics and labor costs associated with such repair often exceeds the cost of replacing the damaged pallet with a new pallet. Disposal of accumulated wooden pallets often becomes a costly issue in itself and is another incentive to ship products (i.e., materials, components, or finished goods) in re-usable (i.e., returnable) bases and pallets. Many businesses may store a number of wooden pallets for reuse, but unless they ship out products on pallets, these stored pallets are mainly used for utility or incidental purposes, not for shipping products.

Damage to shipping bases (e.g., pallets) is usually the result of mishandling by the fork truck or pallet truck operator, and usually consists of dented corners or sides, or missing structural material that has been knocked off or gouged out. Repair of injected molded bases is possible, but since their strength comes from the way the plastic is formed and webbed during the injection molding process, an effective and strong repair and bonding of missing material can be labor intensive and the cost is often a significant portion of a new base. Fully welded fabricated steel or aluminum bases can usually be repaired by cutting out the damaged area, cutting replacement stock, and welding in the replacing stock, but the cost of the repair material plus the skilled labor and tools required for the repair of these type bases is generally cost prohibitive. The skilled labor, tools, and material is usually less as a percentage of new base cost as compared to the injection molded bases, but this is mainly because the initial purchase price of fully welded fabricated bases is higher than the injection molded bases.

Another reason to use alternatives to wooden pallets and shipping bases or containers is that most overseas shipping requires non-organic pallets and shipping bases to reduce the possibility of transporting pests and parasites between countries in the shipping materials. Alternatively, shippers may use treated-wood pallets and containers. The wood treatment is to eliminate any infestation and is certified for such use. The wood used for this purpose is considerably more expensive than the "rough" wood used in wooden pallets for domestic shipping. Even at the elevated prices, these treated wood bases are still generally considered a "single use" option and not returnable to the supplier. Plastic and metal pallets and bases do not suffer from the same restrictions and are much simpler and less costly to prepare for international shipping.

Plastic bases are usually designed to be interlocked and stacked in a compact tower to reduce the volume required for return-shipping them and minimize the return shipping cost per unit. Shipping costs for returns is usually more a function of volume than weight. The bases are designed to fill shipping container (truck trailer or van, railcar, etc.) volume, and because the plastic is less dense than metals or other materials, the weight of the bases does not affect shipping charges.

A shipping base may be a simple platform base, or it may include side panels and corner structures that create more of a box that protects the shipped item or contains loose parts or material for shipping. The side panel style is usually also designed to be stackable, where two or more assembled shipping bases are stacked on top of each other to reduce storage space.

A shipping base is designed to be structurally strong enough to handle a certain weight and provide access for handling equipment (fork truck, etc.), that products being shipped can be moved by during transportation, storage, and processing. When the configuration is that of a simple shipping base or pallet, the product being shipped is usually retained to the base by straps, banding, webbing, or stretch wrap.

Shipping bases or containers that incorporate side panels are generally of two types. One type of side panel base is referred to as a "collapsible base" since the side panels are designed to be folded down onto the empty base after use to minimize return shipping bulk. The panels are set back in place to create the open box configuration when the shipping base is being refilled or reloaded. This style can usually be stacked when loaded, but may be limited in how many levels can be stacked because of how the load is transferred to the next lower base. Many injection molded designs use the erected or collapsible side panels as the load bearing members to hold the container base(s) above, and the strength of these panels becomes the load limit determining factor. Other collapsible designs incorporate corner members that are structurally stronger than the side panels, and these designs can often handle more stacking weight than the side-panel only designs. A second type of side panel base has permanent fixed side panels that are part of the structure. This style is generally of the fabricated metal type, and is often used where very heavy products are shipped. This style requires the same transportation volume to return to the originator as it does when shipping product because the space occupied by the empty base is the same as the loaded base. This style usually can handle more stacking levels of loaded containers than the collapsible styles since the structure is more rigid, especially at the corners.

SUMMARY OF THE INVENTION

Aspects of the present invention provide a re-usable, returnable, stackable, modular shipping base that incorporates replaceable components to make the base relatively quick and cost effective to repair. The shipping base is formed from a number of stamped or cut sheet materials (e.g., sheet metal) that are then folded and attached to one another using a tab system (e.g., riveting the tabs to other components). When a component is damaged, the damaged component may be removed from the base and replaced with another mass produced, stamped sheet material component. Components are attached to one another via adhesive, rivets, stitch welding, spot welding, or any other applicable process.

In another aspect, shipping base for supporting product during storage and transportation of the product includes a top sheet, center junction, and end frame assembly, and a common corner. The top sheet is configured to extend generally horizontally when the shipping base is assembled in an upright position. The top she is configured to support product for storage and transportation on top of said top sheet. The center junction assembly is configured to attach to a bottom of the top sheet at the center of the top sheet and spaced the top sheet from the surface supporting the shipping base when the shipping bases assembled and in the upright position. The end frame assembly is configured to extend along the side of the top sheet and space the top sheet from the surface supporting the shipping base when the shipping base is assembled and in the upright position. The common corner is configured to connect the end frame assembly to a second end frame assembly when the shipping base is assembled and in the upright position.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified.

Figure 1:
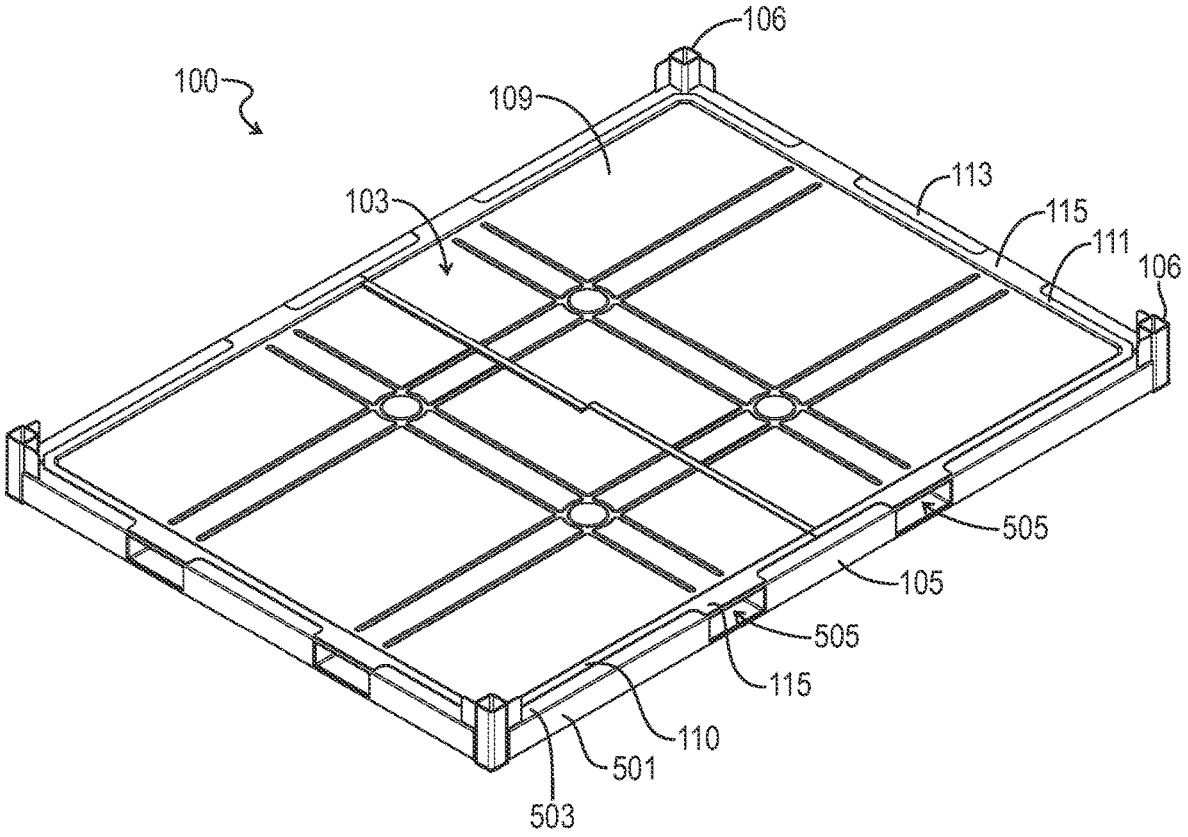
FIG. 1 is an isometric view of a shipping base according to one embodiment of the invention.

The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component. As used herein, the upright position of the shipping base 100 is considered to be as shown for example, in FIG. 1 with a bottom of the shipping base 100 in contact with a generally flat, horizontal surface supporting the shipping base 100 such that the shipping base 100 will contain or support any product placed on a top sheet 103 of the shipping base 100. An end frame assembly 105 and common corners 106 of the shipping base 100 extend generally vertically upward from the surface supporting the shipping base 100 when the shipping base 100 is in the assembled and upright position as shown in FIG. 1. As used herein, generally vertical does not necessarily mean at a 90° angle to the surface supporting the shipping base 100. For many of the generally vertical elements of the components of the shipping base, additional strength may be obtained by having generally vertical surfaces angled out at between about 5 and 20 degrees from perfectly vertical from the surface supporting the shipping base 100 or from the top sheet 103 of the shipping base 100. Similarly, the claims and description herein apply whether the shipping base 100 is considered to be equal in width and depth or longer in either the lateral or longitudinal direction.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-10, a shipping base 100 for supporting product during storage and transportation of the product includes a top sheet 103, center junction assembly 107, and end frame assembly 105, and a common corner 106. The top sheet 103 is configured to extend generally horizontally when the shipping base 100 is assembled and in the upright position. The top sheet 103 is configured to support product for storage and transportation on a top 109 of the top sheet 103. The center junction assembly 107 is configured to attach to a bottom of the top sheet 103 and space the top sheet 103 from a surface supporting the shipping base 100 when the shipping base 100 is assembled and in the upright position. The end frame assembly 105 is configured to extend along a side 110 of the top sheet 103 and space the top sheet 103 from the surface supporting the shipping base 100 when the shipping base 100 is assembled and in the upright position. The common corner 106 is configured to connect the end frame assembly 105 to another end frame assembly of the shipping base 100 when the shipping base 100 is assembled in the upright position. In one embodiment, the common corner 106 may contact, but is not directly attached to the top sheet 103 when the shipping base 100 is assembled. In one embodiment, the end frame assembly 105 is a first end frame assembly 105 of a plurality of end frame assemblies of the shipping base 100, and the plurality of end frame assemblies of the shipping base consists of four end frame assemblies when the shipping base 100 is assembled. In one embodiment, the common corner 106 is a first common corner 106 of a plurality of common corners of the shipping base, and the plurality of common corners of the shipping base consists of four common corners when the shipping base 100 is assembled.

Figure 4:
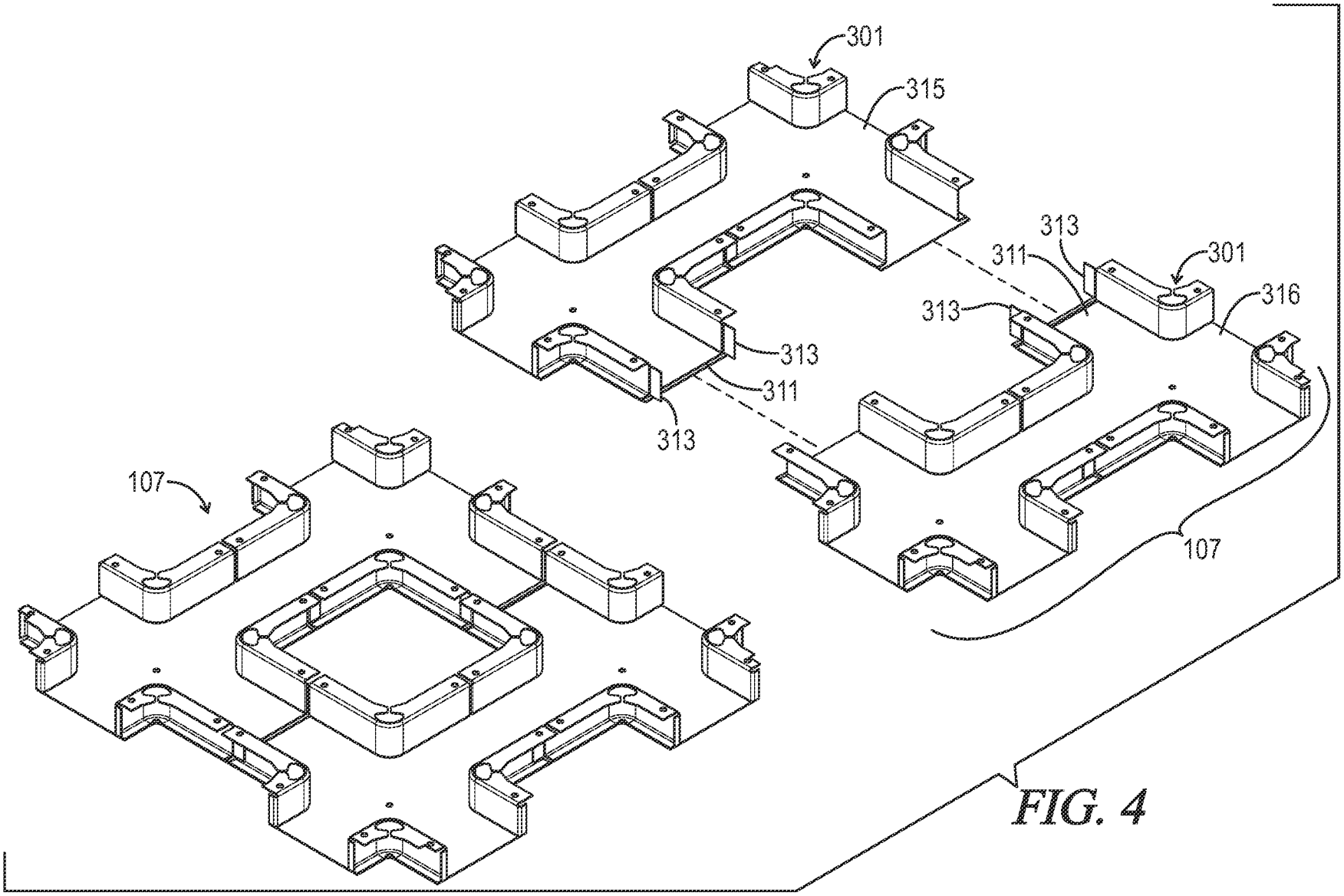
FIG. 4 is an isometric view of a pair of center junctions for a shipping base together with an isometric view of an assembled center junction assembly according to another embodiment of the invention.
Figure 5:
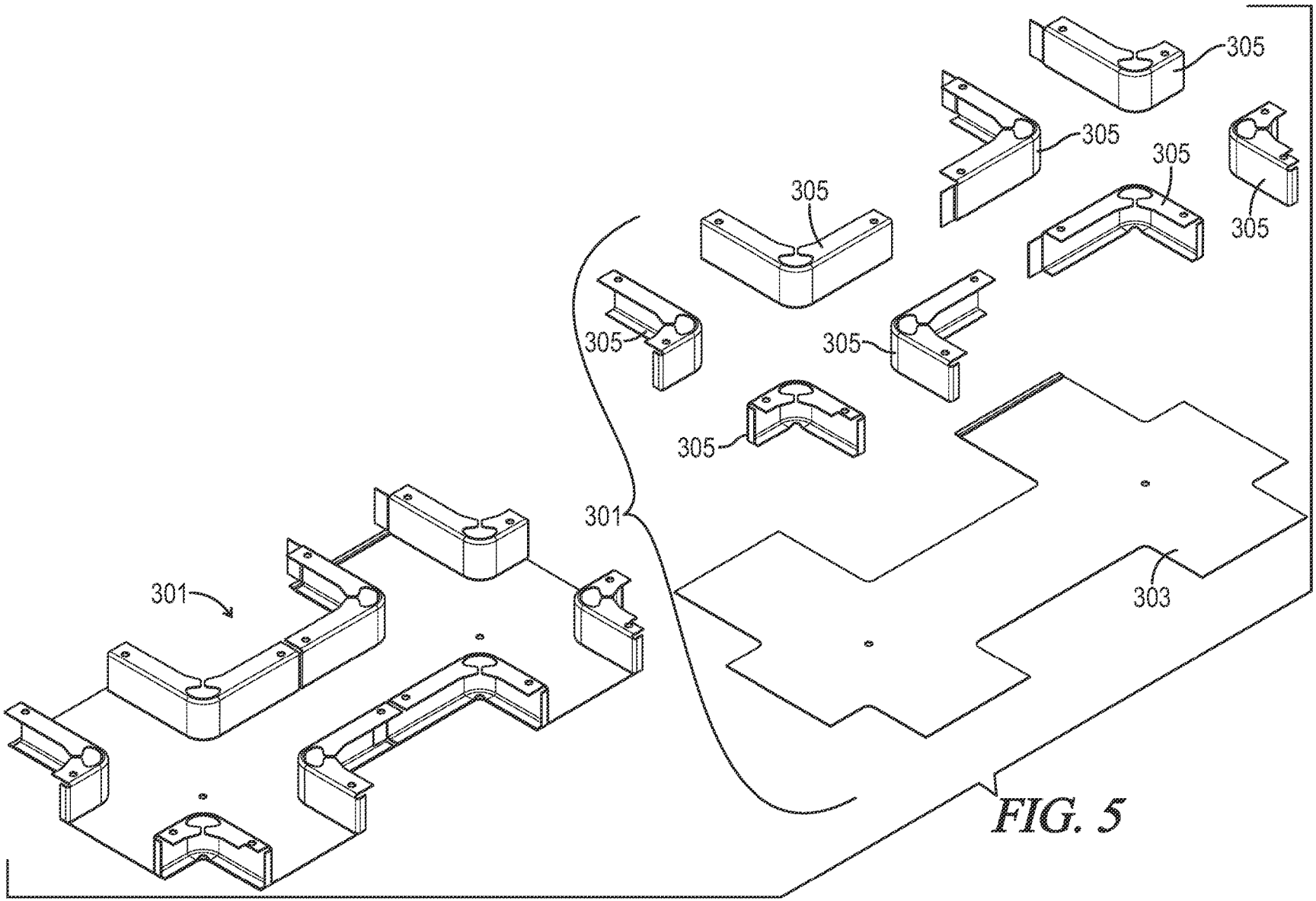
FIG. 5 is an isometric exploded view of the center junction of FIG. 4 together with an isometric view of the assembled center junction.
Figure 6:
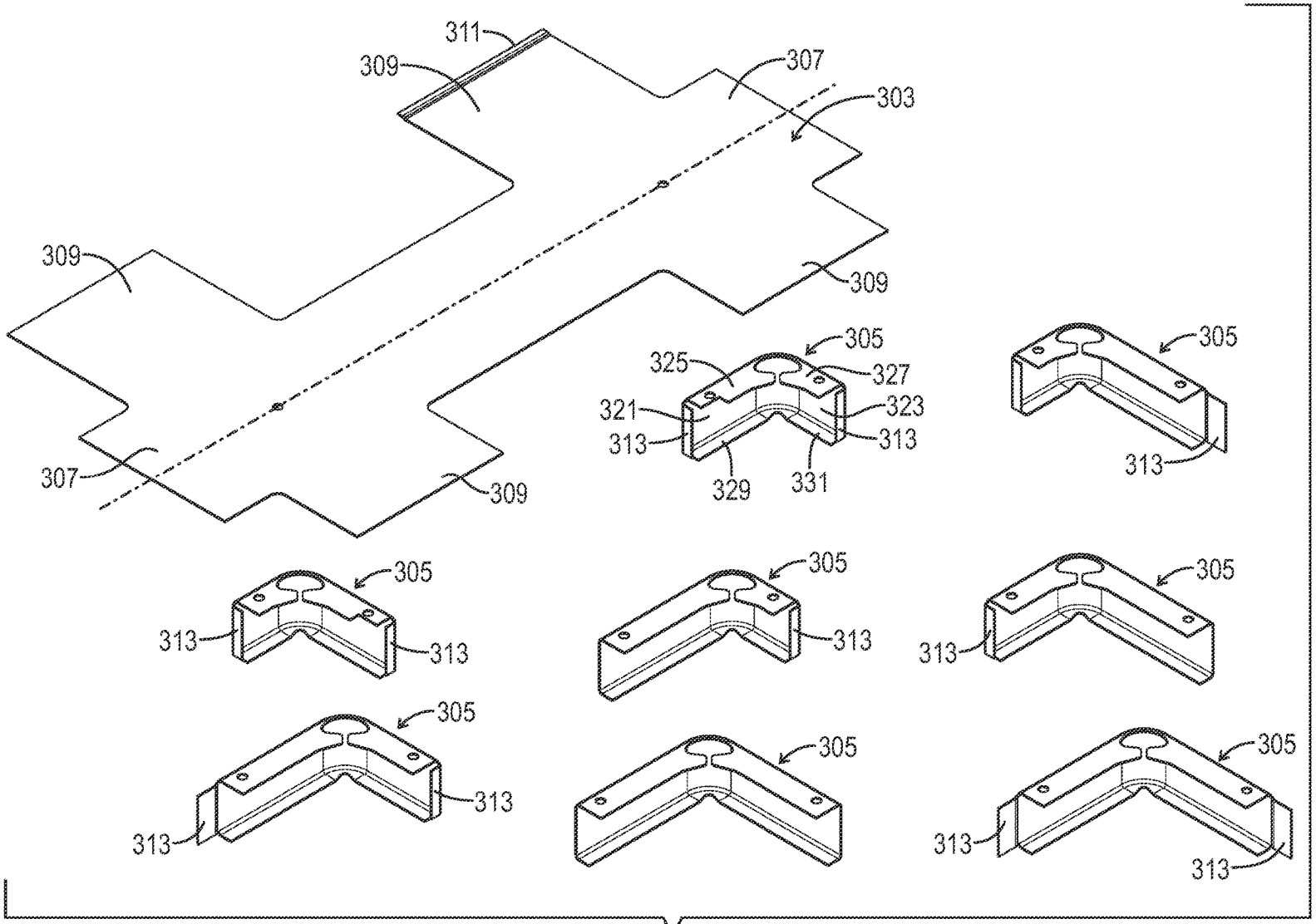
FIG. 6 is an isometric view of the components of the center junction of FIGS. 4 and 5.

Referring especially to FIGS. 4-6, in one embodiment, the center junction assembly 107 includes a plurality of center junctions 301 joined together when the shipping base 100 is assembled. In one embodiment, the center junction 301 includes a base plate 303 and a spanner 305. In one embodiment, the base plate 303 includes a main body 307 extending along an axis and a plurality of protrusions 309 extending generally perpendicular to the axis. A protrusion 309 of the plurality of protrusions 309 includes a raised end portion 311. In one embodiment, the plurality of center junctions 301 includes a first center junction 315 and a second center junction 316. In one embodiment, the first center junction 315 and the second center junction 316 are substantially identical. Each center junction 301 includes a base plate 303 with a protrusion 309 having a raised in portion 311, and the center junctions 315, 316 are attached to one another such that the raised in portion 311 of the first center junction 315 extends over and is attached to a corresponding protrusion 309 of the second center junction 316 and the raised in portion 311 of the second center junction 316 extends over and is attached to a complementary protrusion 309 of the first center junction 315.

In one embodiment, the center junction 301 includes a plurality of spanners 305. A spanner 305 is attached to the base plate 303 at each junction between a protrusion 309 and the main body 307 and extends along each of the main body 307 and the protrusion 309 when the shipping base 100 is assembled. Spanners 305 are configured to attach to one another at abutting sides via end tabs 313. End wall tabs 313 either turn inwardly to about one another, or step outward to engage a side of an adjacent spanner 305. In one embodiment, end wall tabs 313 may also contact and be attached to the end frame assembly 105, particularly a side rail 501 of the end frame assembly 105. In one embodiment, the spanner 305 includes a first side 321, a second side 323, a first upper tab 325, a second upper tab 327, a first lower tab 329, and a second lower tab 331. The second side 323 adjoins and extends generally perpendicular from the first side 321. The first upper tab 325 extends horizontally from the top of the first side 321 when the shipping base 100 is assembled and in the upright position. The second upper tab 327 extends horizontally from the top of the second side 323 when the shipping base 100 is assembled and in the upright position. The first lower tab 329 extends horizontally from a bottom of the first side 321 when the shipping base 100 is assembled and in the upright position. The second lower tab 331 extends horizontally from a bottom of the second side 323 when the shipping base 100 is assembled in the upright position. The first upper tab 325 and second upper tab 327 extend inwardly toward one another. The first lower tab 329 and the second lower tab 331 extend inwardly toward one another. In one embodiment, the first side 321, second side 323, first upper tab 325, first lower tab 329, second upper tab 327 and second lower tab 331 are integrally formed with one another. In one embodiment, the spanner 305 is formed by stamping a blank from sheet-metal, folding the first upper tab 325 and second upper tab 327, folding the first lower tab 329 and second lower tab 331, and then bending the blank (e.g., mandrel bending) such that the first upper tab 325 and second upper tab 327 are brought closer to one another by the bending. The first upper tab 325 and second upper tab 327 are attached to the top plate 103, and the first lower tab 329 and second lower tab 331 are attached to a base plate 303 when the shipping base 100 is assembled.

Figure 2:
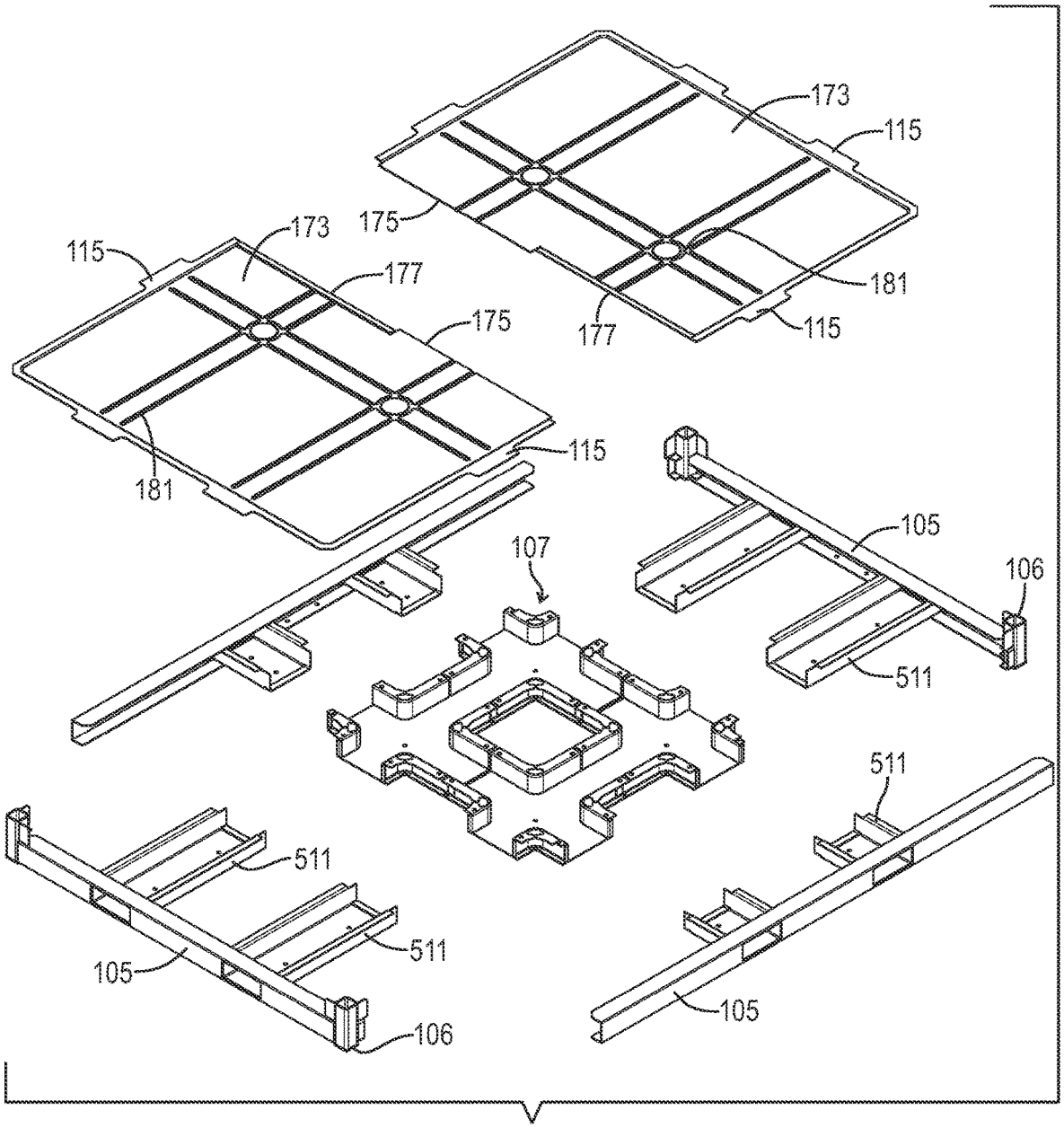
FIG. 2 is a partially exploded isometric view of the shipping base of FIG. 1.
Figure 3:
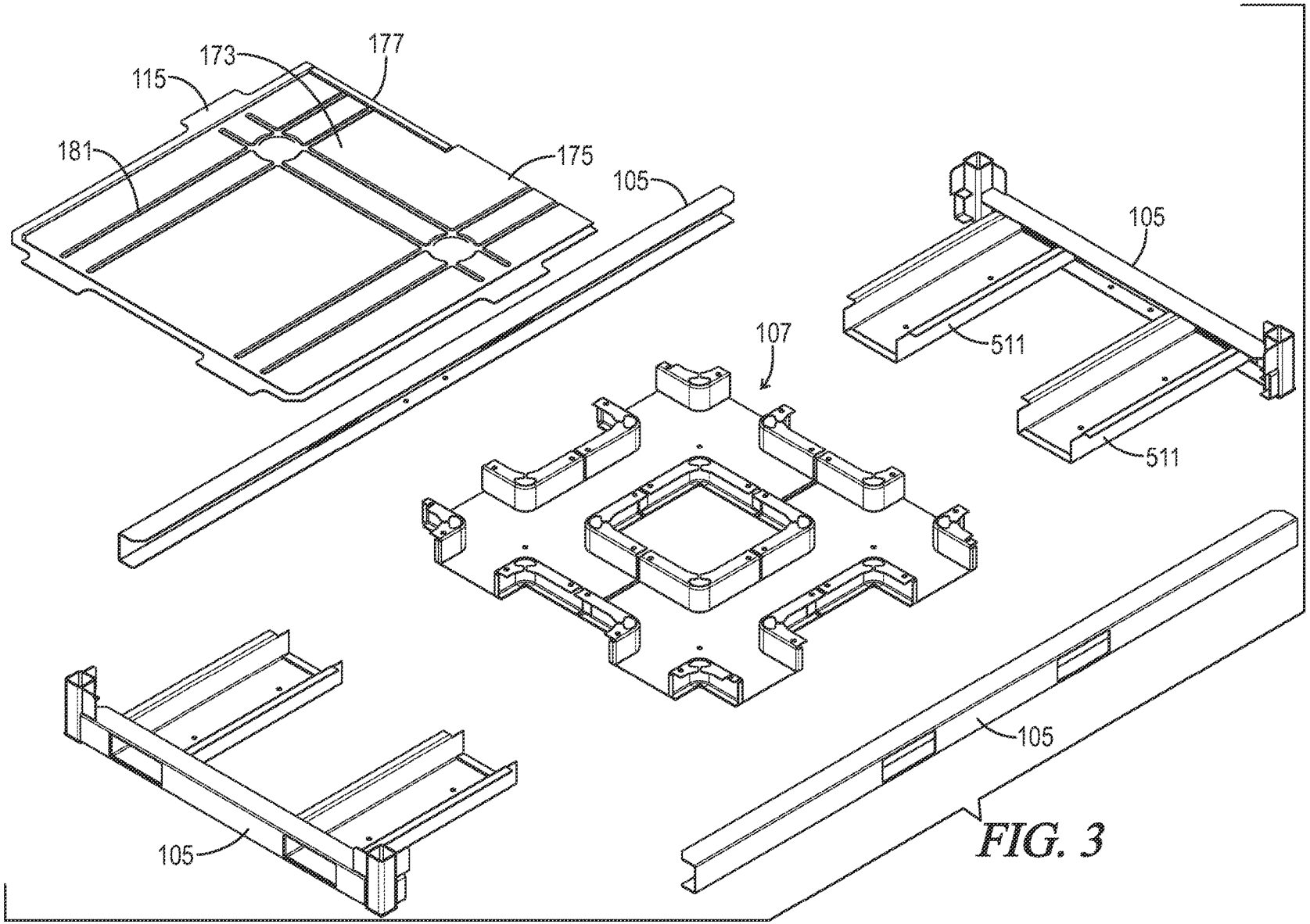
FIG. 3 is a partially exploded isometric view of a shipping base according to another embodiment of the invention.

Referring especially to FIGS. 1-3, the top sheet 103 includes a tab 115 configured to contact a top (e.g., top rail 503) of the end frame assembly 105 when the shipping base 100 is assembled and in the upright position. The tab 115 extends over the end frame assembly 105 above a fork hole 505 in the end frame assembly 105 when the shipping base 100 is assembled and in the upright position. The fork hole 505 is configured to receive a fork of a forklift lifting the shipping base 100 from the surface supporting the shipping base 100. In one embodiment, the tab 115 extends over the end frame assembly 105 above the fork hole 505 through the side rail 501 of the end frame assembly 105 when the shipping base 100 is assembled in the upright position. The top sheet 103 is attached to the top rail 503 of the end frame assembly 105 when the shipping base 100 is assembled. In one embodiment, the top sheet 103 includes a plurality of top plates 173. The top plate 173 includes the tab 115. In one embodiment, the top sheet 103 a plurality of tabs 115 configured to extend over the fork holes 505 in the end frame assemblies 105 of the shipping base 100 such that a tab 115 extends over each fork hole 505 of each end frame assembly 105 of the shipping base 100 when the shipping base 100 is assembled and in the upright position. In one embodiment, the top plate 173 is generally rectangular such that the top plate 173 has four sides, and the top plate 173 has tabs 115 extending from three sides of the top plate 173. The side of the top plate 173 without tabs 115 includes a level portion 175 and a recessed portion 177. The recessed portion 177 has an elevation lower than the level portion 175 when the shipping base 100 is assembled in the upright position. In one embodiment, each top plate 173 is formed with a plurality of grooves 181 depressed from the level portion 175 of the top plate 173 when the shipping base 100 is assembled and in the upright position such that the plurality of grooves 181 add rigidity to each of the top plates 173. The plurality of grooves 181 may also be used to center or locate the top plate 173 relative to the other components of the shipping base 100. During assembly of the shipping base 100. In one embodiment, the top sheet 103 includes 2 top plates 173, and the level portion 175 of one of the top plates 173 is attached to the recessed portion 177 of the other top plate and vice versa when the shipping base 100 is assembled and in the upright position. In one embodiment, each top plate 173 is formed from sheet metal via a stamping operation.

Figure 7:
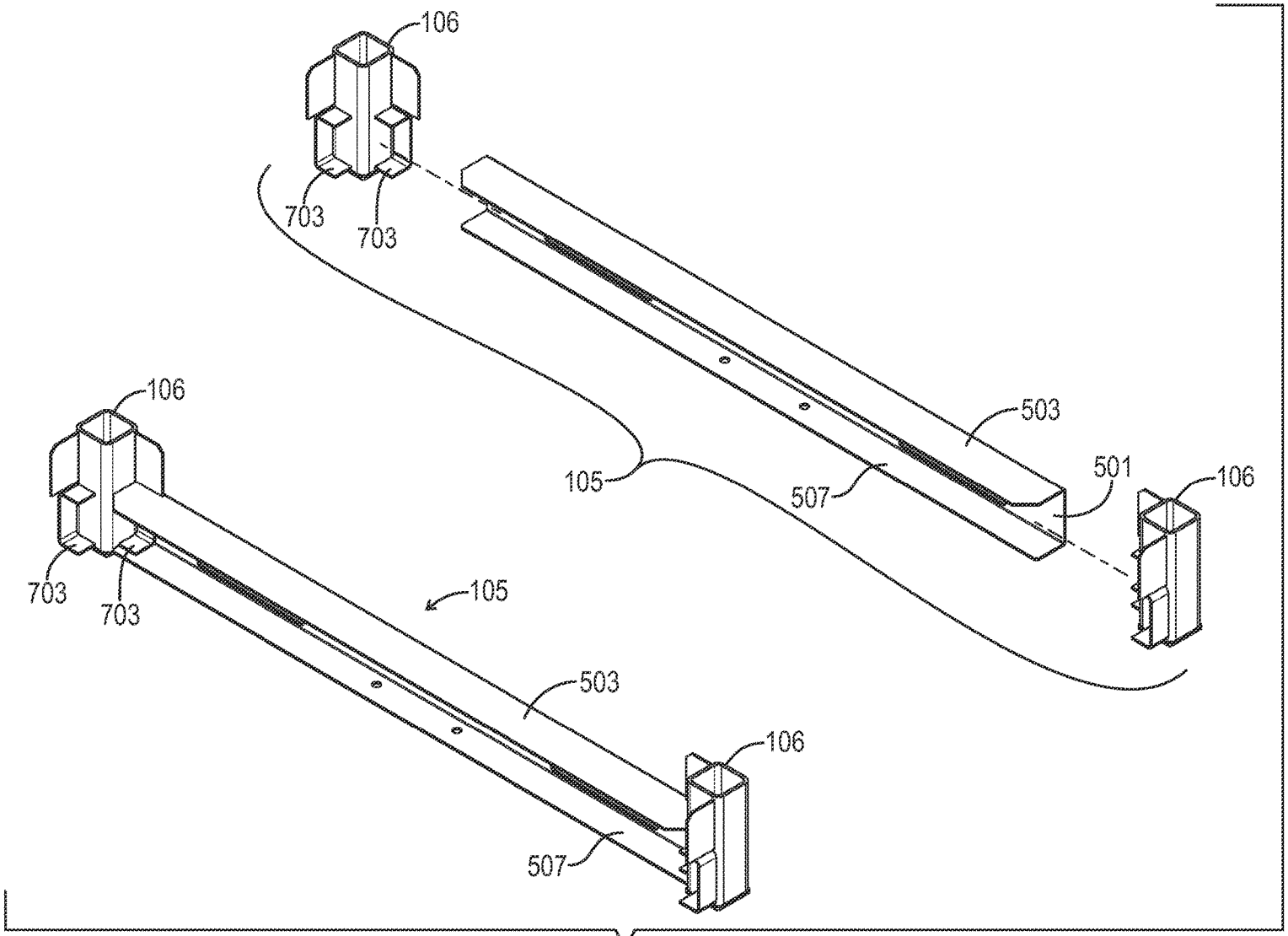
FIG. 7 is an exploded isometric view of an end frame assembly and common corners together with an isometric view of the assembled end frame assembly and common corners according to one embodiment of the invention.
Figure 8:
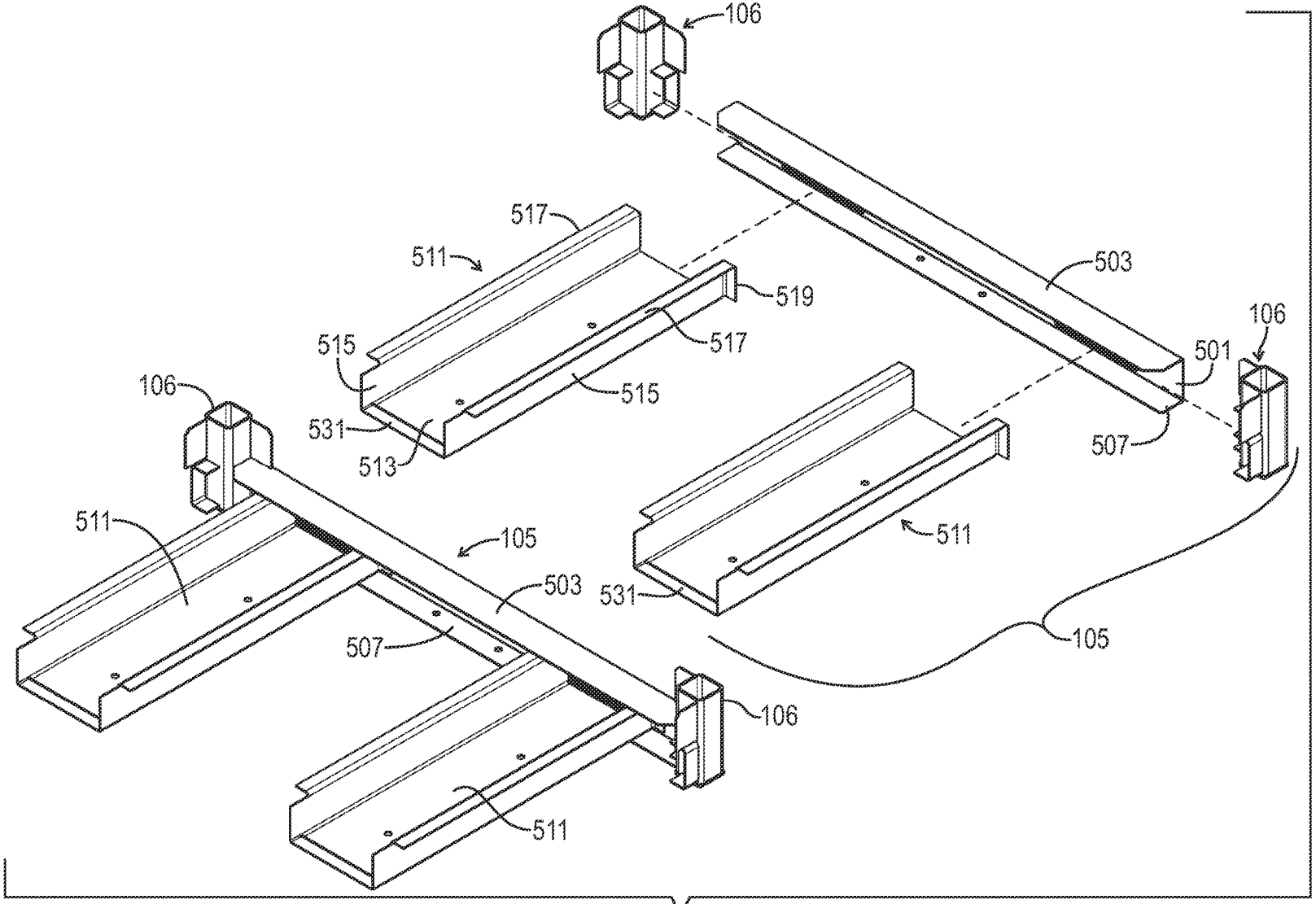
FIG. 8 is an isometric exploded view of an end frame assembly and common corners together with an isometric view of the end frame assembly and common corners according to one embodiment of the invention.

Referring especially to FIGS. 7 and 8, in one embodiment, the end frame assembly 105 includes a top rail 503, a side rail 501, and a bottom rail 507. The end frame assembly 105 is attached to the top sheet 103, center junction assembly 107, and common corner 106 when the shipping base 100 is assembled. In one embodiment, top rail 503 extends generally horizontally and is configured to attach to the bottom of the top sheet 103 when the shipping base 100 is assembled and in the upright position. The side rail 501 extends generally downward from the top rail 503 when the shipping base 100 is assembled and in the upright position. The bottom rail 507 extends generally horizontally from the side rail 501 below the top rail 503 when the shipping base 100 is assembled and in the upright position. In one embodiment, the side rail 501 has a fork hole 505 therethrough configured to receive a fork of a forklift when the forklift is lifting the shipping base 100 from the surface supporting the shipping base. In one embodiment, the top rail 503 is formed by folding the top rail 503 from the side rail 501 along the top edge of the side rail 501, and the bottom rail 507 is similarly formed by folding the bottom rail 507 from the side rail 501 along a bottom edge of the side rail 501 such that the top rail 503 and bottom rail 507 each extends generally horizontally from the side rail 501 in the same direction and the top rail 503 is above or over the bottom rail 507 when the shipping base 100 is assembled and in the upright position.

In one embodiment, the end frame assembly 105 further includes a fork channel 511. The fork channel 511 is configured to attach to the side rail 501, top rail 503, and bottom rail 507 when the shipping base 100 is assembled such that the fork channel 511 extends inwardly from the top rail 503, side rail 501, and bottom rail 507. In one embodiment, the fork channel 511 is configured to attach to the center junction assembly 107 and the top sheet 103 when the shipping base 100 is assembled. In one embodiment, the fork channel 511 is configured to attach to the side rail 501 about the fork hole 505 through the side rail 501. In one embodiment, the fork channel 511 includes a bottom 513, a pair of opposing side walls 515, a pair of top sheet tabs 517, and a pair of side rail tabs 519, said pair of side rail tabs at a first end of the fork channel 511. The bottom 513 is configured to extend generally horizontally when the shipping base 100 is assembled and in the upright position. The pair of opposing side walls 515 are configured to extend generally upwardly from the bottom 513 of the fork channel 511 when the shipping base 100 is assembled in the upright position. Each top sheet tab 517 of the pair of top sheet tabs 517 extend generally horizontally and outwardly from one of the side walls 515 of the pair of opposing side walls 515. The pair of side rail tabs 519 are configured to attach to the side rail 501 of the end frame assembly 105 when the shipping base 100 is assembled. Each side rail tab 519 of the pair of side rail tabs 519 extends outwardly from a side wall 515 of the pair of opposing side walls 515. The bottom 513 of the fork channel 511 and the pair of opposing side walls 515 of the fork channel extend beyond the pair of top sheet tabs 517 at a second end of the fork channel 511 opposite the first end of the fork channel 511 (i.e., opposite the side rail tabs 519). In one embodiment, the second end of the fork channel 511 is configured to be received in the center junction assembly 107 when the shipping base 100 is assembled. The side walls 515 of the pair of opposing side walls are configured to attach to spanners 305 of the center junction assembly 107 when the shipping base 100 is assembled. The bottom 513 of the fork channel assembly 511 is configured to attach to the base plate 303 of the center junction assembly 107 when shipping base 100 assembled. In one embodiment, the bottom 513 of the fork channel 511 includes a raised section 531. The raised section at the second end of the fork channel 511 is configured to extend over and attached to the base plate 303 of the center junction assembly 107 when the shipping base 100 is assembled and in the upright position. In another embodiment, the bottom 513 of the fork channel 511 increases in elevation and the pair of opposing side walls 515 decrease in height from the first end of the fork channel 511 to the second end of the fork channel 511 such that the second end of the fork channel 511 is configured to extend over and attached to the base plate 303 of the center junction assembly 107 when the shipping base 100 is assembled and in the upright position. That is, the fork channel 515 necks down from the first end of the fork channel toward the second end of the fork channel 511 such that the second end of the fork channel 511 can be received in the center junction assembly 107.

In one embodiment, a first end frame assembly 105 is configured to extend along the first side 110 of the top sheet 103. The top sheet 103 has a second side 111 extending generally perpendicular to the first side 110. The shipping base 100 further includes a second end frame assembly 113 configured to extend along the second side 111 of the top sheet 103. The common corner 106 is configured to attach to the first end frame assembly 105 and the second end frame assembly 113. In one embodiment, the end frame assemblies 105, 113 are configured to attach to the bottom of the top sheet 103 when the shipping base 100 is assembled and in the upright position.

Figure 9:
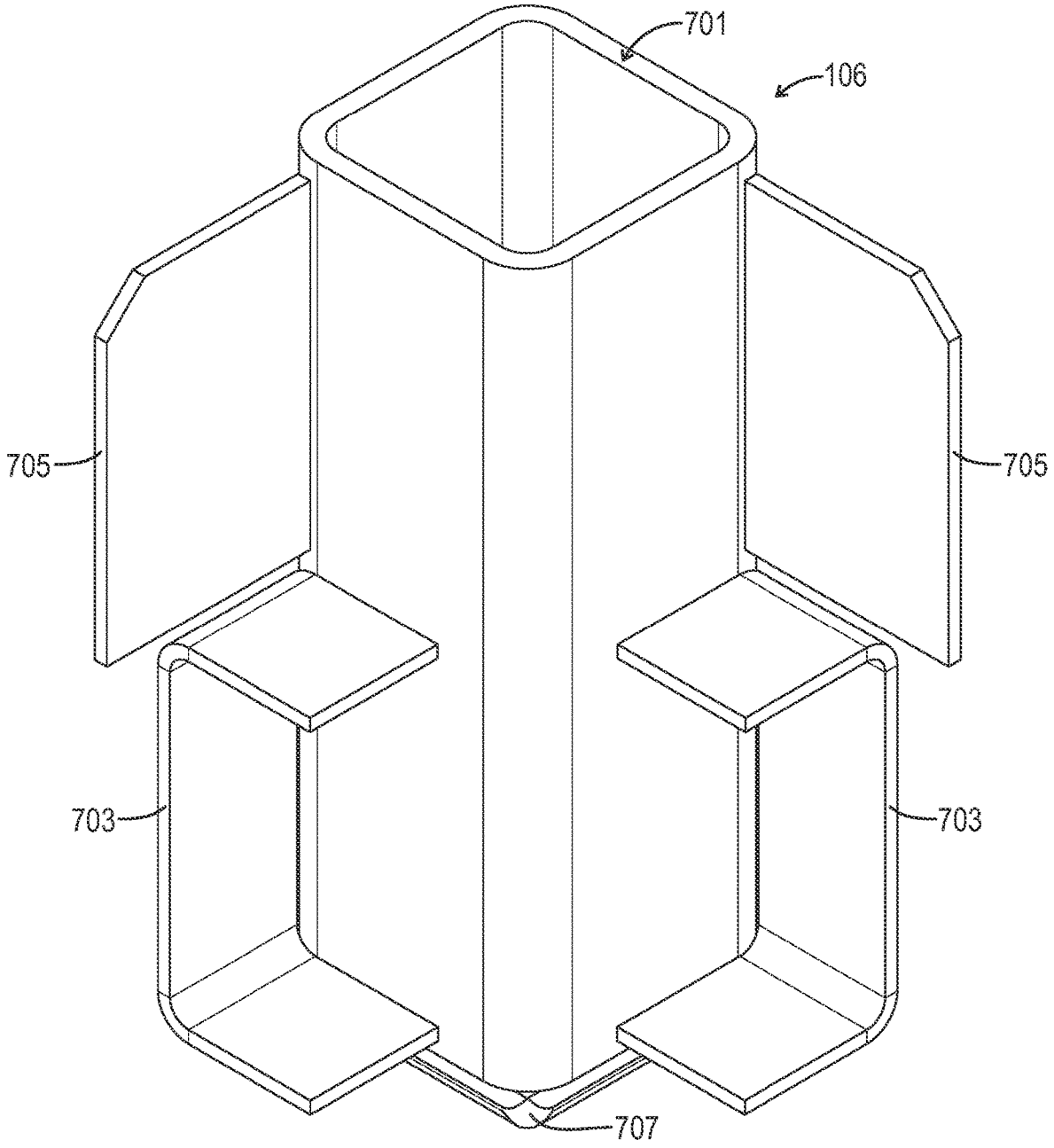
FIG. 9 is an isometric view of a common corner according to one embodiment of the invention.
Figure 10:
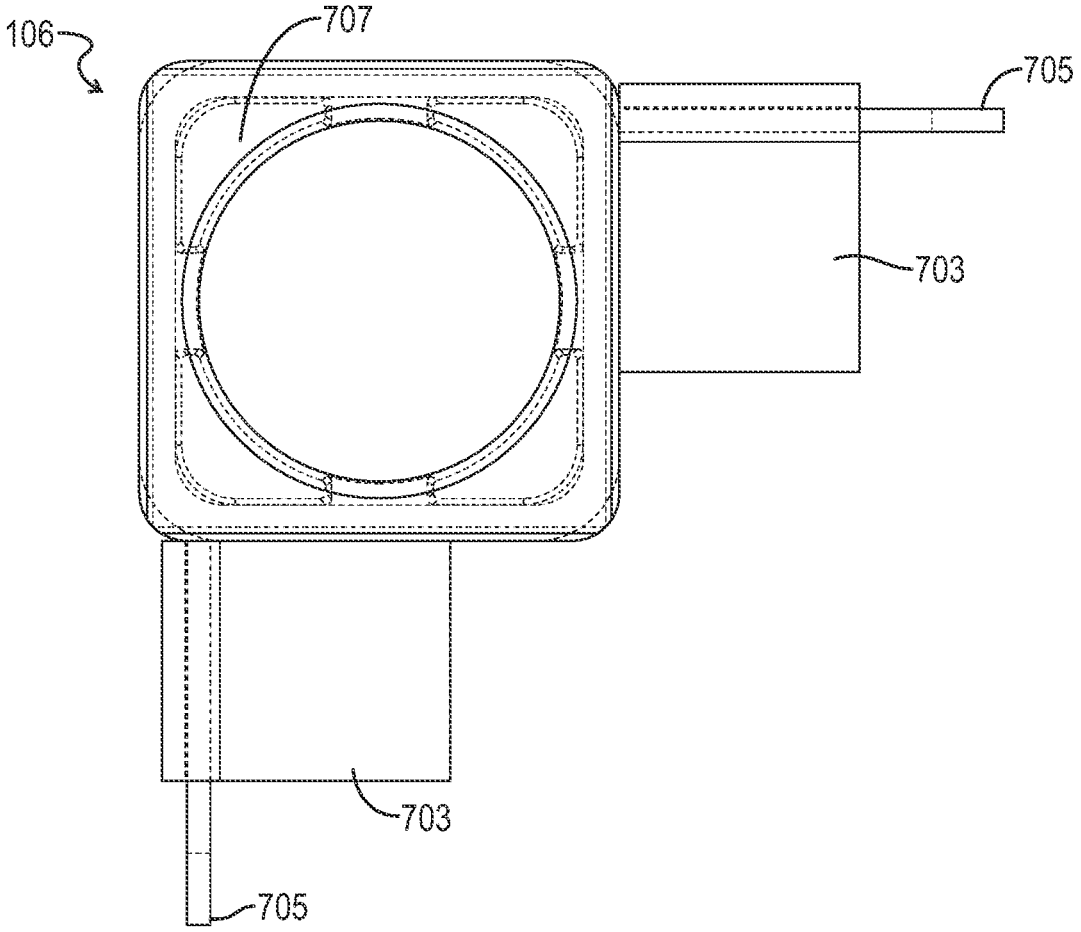
FIG. 10 is a bottom plan view of the common corner of FIG. 9.

Referring especially to FIGS. 9 and 10, in one embodiment, the common corner 106 includes a body portion 701 formed of rectangular tubing such that the body portion 701 has 4 sides into ends. The rectangular tubing extends generally vertically when the shipping base 100 is assembled and in the upright position. Each corner attachment bracket 703 of the pair of a corner attachment brackets is attached to one side of a pair of adjacent sides of the 4 sides of the body portion 701. That is, the pair of corner attachment bracket 703 are attached to adjacent sides of the body portion 701 of the common corner 106. The corner attachment brackets 703 are configured to attach to the end frame assemblies 105, 106 of the shipping base 100. In one embodiment, the common corner 106 further includes a pair of end frame connectors 705 each end frame connectors 705 is configured to extend from the side of the pair of adjacent sides of the body portion 701 over each corner attachment bracket 703 when the shipping base 100 is assembled in the upright position. In one embodiment, the common corner 106 further includes a nesting cap 707. The nesting cap 707 is configured to connect to attach to the bottom end of the body portion 701 such that the shipping base 100 rests on the nesting cap 707 when the shipping base rests on the surface supporting shipping base 100. The nesting cap 707 has a generally circular hole therethrough to promote stacking of multiple shipping bases 100 via poles or supports. In one embodiment, the corner attachment bracket 703 is C-shaped and oriented such that the corner attachment bracket 703 has surfaces configured to attach to the top rail 503, side rail 501, and bottom rail 507 of the end frame assembly 105 to which the common corner 106 is attached when the shipping base 100 is assembled. In one embodiment, the corner attachment bracket 703 is positioned inward of the top rail 503, side rail 501, and bottom rail 507 of the end frame assembly 105 when the shipping base 100 is assembled. That is, the C-shaped corner attachment bracket 703 generally nests within the end frame assembly 105 at an end of the end frame assembly 105. It is contemplated within the scope of the claims that the corner attachment bracket 703 may alternatively wrap around the rails of the end frame assembly 105.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MODULAR SHIPPING BASE it is not intended that such references be construed as limitations upon the scope of this invention except as set forth in the following claims.

What is claimed is:

1. A shipping base for supporting product during storage and transportation of the product, said shipping base comprising:

a top sheet configured to extend generally horizontally when the shipping base is assembled and in an upright position, said top sheet configured to support product for storage and transportation on a top of said top sheet;

a center junction assembly configured to attach to a bottom of the top sheet and space the top sheet from a surface supporting the shipping base when the shipping base is assembled and in the upright position;

an end frame assembly configured to extend along a side of the top sheet, and space the top sheet from the surface supporting the shipping base when the shipping base is assembled and in the upright position; and a common corner configured to connect the end frame assembly to another end frame assembly of the shipping base when the shipping base is assembled and in the upright position.

2. The shipping base of claim 1, wherein:

the end frame assembly is a first end frame assembly configured to extend along a first side of the top sheet;

the top sheet has a second side extending generally perpendicular to the first side;

the shipping base further comprises a second end frame assembly configured to extend along the second side of the top sheet; and the common corner is configured to attach to the first end frame assembly and the second end frame assembly.

3. The shipping base of claim 1, wherein:

the end frame assembly is a first end frame assembly of a plurality of end frame assemblies of the shipping base;

the plurality of end frame assemblies of the shipping base consists of four end frame assemblies when the shipping base is assembled;

the common corner is a first common corner of a plurality of common corners of the shipping base; and the plurality of common corners of the shipping base consists of four common corners when the shipping base is assembled.

4. The shipping base of claim 1, wherein:

the center junction assembly comprises a center junction;

the center junction comprises a base plate and a plurality of spanners;

the base plate comprises a main body extending along an axis and a plurality of protrusions extending generally perpendicular to the axis;

a spanner is attached to the base plate at each junction between a protrusion and the main body and extends along each of the main body and the protrusion when the shipping base is assembled; and spanners are configured to attach to one another at abutting sides via end tabs when the shipping base is assembled.

5. The shipping base of claim 1, wherein:

the center junction assembly comprises a plurality of center junctions joined together when the shipping base is assembled;

the center junction assembly comprises a center junction;

the center junction comprises a base plate;

the base plate comprises a main body extending along an axis and a plurality of protrusions extending generally perpendicular to the axis;

a protrusion of the plurality of protrusions comprises a raised end portion;

the center junction is a first center junction of the plurality of center junctions, the axis of the main body of the first center junction is a first axis, and the base plate of the first center junction is a first base plate;

the center junction assembly comprises a second center junction of the plurality of center junctions;

the second center junction comprises a second base plate;

the second base plate of the second center junction comprises a main body extending along a second axis and a plurality of protrusions extending generally perpendicular to the second axis;

a protrusion of the plurality of protrusions of the second base plate comprises a raised end portion;

the raised end portion of the first base plate extends over and is attached to a protrusion of the plurality of protrusions of the second base plate when the shipping base is assembled and in the upright position; and the raised end portion of the second base plate extends over and is attached to a protrusion of the plurality of protrusions of the first base plate when the shipping base is assembled and in the upright position.

6. The shipping base of claim 1, wherein:

the center junction assembly comprises a center junction;

the center junction comprises a spanner;

the spanner comprises:

a first side;

a second side adjoining and extending generally perpendicular from the first side;

a first upper tab extending horizontally from a top of the first side when the shipping base is assembled and in the upright position;

a second upper tab extending horizontally from a top of the second side when the shipping base is assembled and in the upright position;

a first lower tab extending horizontally from a bottom of the first side when the shipping base is assembled and in the upright position; and a second lower tab extending horizontally from a bottom of the second side when the shipping base is assembled and in the upright position;

the first upper tab and the second upper tab extend inwardly toward one another;

the first lower tab and the second lower tab extend inwardly toward one another; and the first side, second side, first upper tab, second upper tab, first lower tab, and second lower tab are integrally formed with one another by stamping a blank from sheet metal, folding the first upper tab and second upper tab, folding the second lower tab and the first lower tab, and bending the blank such that the first upper tab and second upper tab are brought closer to one another.

7. The shipping base of claim 1, wherein:

the center junction assembly comprises a center junction;

the center junction comprises a spanner;

the spanner comprises:

a first side;

a second side adjoining and extending generally perpendicular from the first side;

a first upper tab extending horizontally from a top of the first side when the shipping base is assembled and in the upright position;

a second upper tab extending horizontally from a top of the second side when the shipping base is assembled and in the upright position;

a first lower tab extending horizontally from a bottom of the first side when the shipping base is assembled and in the upright position; and a second lower tab extending horizontally from a bottom of the second side when the shipping base is assembled and in the upright position;

the first upper tab and the second upper tab extend inwardly toward one another;

the first lower tab and the second lower tab extend inwardly toward one another;

the first upper tab and the second upper tab are attached to the top plate when the shipping base is assembled; and the first lower tab and the second lower tab are attached to a base plate of the center junction when the shipping base is assembled.

8. The shipping base of claim 1, wherein:

the top sheet comprises a tab configured to contact a top of the end frame assembly when the shipping base is assembled and in the upright position;

the tab extends over the end frame assembly above a fork hole in the end frame assembly when the shipping base is assembled and in the upright position, said fork hole configured to receive a fork of a fork lift lifting the shipping base from the surface supporting the shipping base.

9. The shipping base of claim 1, wherein:

the top sheet comprises a tab configured to contact a top rail of the end frame assembly when the shipping base is assembled and in the upright position;

the tab extends over the end frame assembly above a fork hole in a side rail of the end frame assembly when the shipping base is assembled and in the upright position, said fork hole configured to receive a fork of a fork lift lifting the shipping base from the surface supporting the shipping base; and the top sheet is attached to the top rail of the end frame assembly when the shipping base is assembled.

10. The shipping base of claim 1, wherein:

the top sheet comprises a top plate;

the top plate is generally rectangular such that the top plate has 4 sides;

the top plate has tabs extending from 3 sides of the top plate; and a side of the top plate without tabs includes a level portion and a recessed portion, the recessed portion having an elevation lower than the level portion when the shipping base is assembled and in the upright position.

11. The shipping base of claim 1, wherein:

the top sheet comprises two top plates;

each top plate is generally rectangular such that the top plate has 4 sides;

each top plate has tabs extending from 3 sides of the top plate;

a side of each top plate without tabs includes a level portion and a recessed portion, the recessed portion having an elevation lower than the level portion when the shipping base is assembled and in the upright position; and the level portion of one of the top plates is attached to the recessed portion of the other top plate and vice versa when the shipping base is assembled and in the upright position.

12. The shipping base of claim 1, wherein:

the end frame assembly comprises:

a top rail extending generally horizontally and configured to attach to the bottom of the top sheet when the shipping base is assembled and in the upright position;

a side rail extending generally downward from the top rail when the shipping base is assembled and in the upright position; and a bottom rail extending generally horizontally from the side rail below the top rail when the shipping base is assembled and in the upright position.

13. The shipping base of claim 1, wherein:

the end frame assembly comprises:

a top rail;

a side rail; and a bottom rail;

the top rail, side rail, and bottom rail are integrally formed;

the top rail is formed by folding the top rail from the side rail along a top edge of the side rail;

the bottom rail is formed by folding the bottom rail from the side rail along a bottom edge of the side rail; and the top rail and bottom rail each extend generally horizontally from the side rail in the same direction such that the top rail is over the bottom rail when the shipping base is assembled and in the upright position.

14. The shipping base of claim 1, wherein:

the end frame assembly comprises:

a top rail;

a side rail;

a bottom rail; and a fork channel;

the fork channel is configured to attach to the side rail, top rail, and bottom rail when the shipping base is assembled; and the fork channel is configured to attach to the center junction assembly and the top sheet when the shipping base is assembled.

15. The shipping base of claim 1, wherein:

the end frame assembly comprises:

a fork channel;

the fork channel comprises:

a bottom configured to extend generally horizontally when the shipping base is assembled and in the upright position;

a pair of opposing sidewalls extending generally upwardly from the bottom of the fork channel when the shipping base is assembled and in the upright position;

a pair of top sheet tabs, each top sheet tab extending generally horizontally and outwardly from one of the sidewalls of the pair of opposing sidewalls;

a pair of side rail tabs at a first end of the fork channel, said pair of side rail tabs configured to attach to a side rail of the end frame assembly when the shipping base is assembled, each side rail tab of the pair of side rail tabs extending outwardly from a sidewall of the pair of opposing sidewalls;

the bottom of the fork channel and the pair of opposing sidewalls of the fork channel extend beyond pair of top sheet tabs at a second end of the fork channel opposite the first end of the fork channel.

16. The shipping base of claim 1, wherein:

the end frame assembly comprises:

a fork channel;

the fork channel comprises:

a bottom configured to extend generally horizontally when the shipping base is assembled and in the upright position;

a pair of opposing sidewalls extending generally upwardly from the bottom of the fork channel when the shipping base is assembled and in the upright position;

a pair of top sheet tabs, each top sheet tab extending generally horizontally and outwardly from one of the sidewalls of the pair of opposing sidewalls;

a pair of side rail tabs at a first end of the fork channel, said pair of side rail tabs configured to attach to a side rail of the end frame assembly when the shipping base is assembled, each side rail tab of the pair of side rail tabs extending outwardly from a sidewall of the pair of opposing sidewalls;

the bottom of the fork channel and the pair of opposing sidewalls of the fork channel extend beyond pair of top sheet tabs at a second end of the fork channel opposite the first end of the fork channel;

the second end of the fork channel is configured to be received in the center junction assembly when the shipping base is assembled;

the sidewalls of the pair of opposing sidewalls are configured to attach to spanners of the center junction assembly when the shipping base is assembled;

the bottom of the fork channel is configured to attach to a base plate of the center junction assembly when the shipping base is assembled; and the bottom of the fork channel comprises a raised section at the second end of the fork channel, said raised section at the second end of the fork channel configured to extend over and attach to the base plate of the center junction assembly when the shipping base is assembled and in the upright position.

17. The shipping base of claim 1, wherein:

the end frame assembly comprises:

a fork channel;

the fork channel comprises:

a bottom configured to extend generally horizontally when the shipping base is assembled and in the upright position;

a pair of opposing sidewalls extending generally upwardly from the bottom of the fork channel when the shipping base is assembled and in the upright position;

a pair of top sheet tabs, each top sheet tab extending generally horizontally and outwardly from one of the sidewalls of the pair of opposing sidewalls;

a pair of side rail tabs at a first end of the fork channel, said pair of side rail tabs configured to attach to a side rail of the end frame assembly when the shipping base is assembled, each side rail tab of the pair of side rail tabs extending outwardly from a sidewall of the pair of opposing sidewalls;

the bottom of the fork channel and the pair of opposing sidewalls of the fork channel extend beyond pair of top sheet tabs at a second end of the fork channel opposite the first end of the fork channel;

the second end of the fork channel is configured to be received in the center junction assembly when the shipping base is assembled;

the sidewalls of the pair of opposing sidewalls are configured to attach to spanners of the center junction assembly when the shipping base is assembled;

the bottom of the fork channel is configured to attach to a base plate of the center junction assembly when the shipping base is assembled; and the bottom of the fork channel increases in elevation and the pair of opposing sidewalls decrease in height from the first end of the fork channel to the second end of the fork channel such that the second end of the fork channel is configured to extend over and attach to the base plate of the center junction assembly when the shipping base is assembled and in the upright position.

18. The shipping base of claim 1, wherein:

the common corner comprises:

a body portion formed of rectangular tubing such that the body portion has four sides and two ends, said rectangular tubing extending generally vertically when the shipping base is assembled and in the upright position; and a pair of corner attachment brackets, each corner attachment bracket of the pair of corner attachment brackets attached to one side of a pair of adjacent sides of the four sides of the body portion;

a pair of end frame connectors, each end frame connector configured to extend from a side of the pair of adjacent sides over each corner attachment bracket when the shipping base is assembled and in the upright position; and a corner attachment bracket of the pair of corner attachment brackets is configured to attach to the end frame assembly of the shipping base.

19. The shipping base of claim 1, wherein:

the common corner comprises:

a body portion formed of rectangular tubing such that the body portion has four sides and two ends, said rectangular tubing extending generally vertically when the shipping base is assembled and in the upright position such that the two ends are a top end and a bottom end; and a pair of corner attachment brackets, each corner attachment bracket of the pair of corner attachment brackets attached to one side of a pair of adjacent sides of the four sides of the body portion;

a pair of end frame connectors, each end frame connector configured to extend from a side of the pair of adjacent sides over each corner attachment bracket when the shipping base is assembled and in the upright position;

a nesting cap configured to connect to the bottom end of the body portion, said nesting cap having a generally circular hole therethrough; and a corner attachment bracket of the pair of corner attachment brackets is configured to attach to the end frame assembly of the shipping base.

20. The shipping base of claim 1, wherein:

the common corner comprises:

a body portion formed of rectangular tubing such that the body portion has four sides and two ends, said rectangular tubing extending generally vertically when the shipping base is assembled and in the upright position; and a corner attachment bracket attached to one side the four sides of the body portion; and the corner attachment bracket is configured to attach to the end frame assembly of the shipping base;

the corner attachment bracket is C shaped and oriented such that the corner attachment bracket has surfaces configured to attach to a top rail, a side rail, and a bottom rail of the end frame assembly to which the common corner is attached when the shipping base is assembled; and the corner attachment bracket is positioned inward of the top rail, the side rail, and the bottom rail of the end frame assembly when the shipping base is assembled.

* * * * *